United States Patent [19]

Reinhart

[11] Patent Number: 4,920,600

[45] Date of Patent: May 1, 1990

[54] PIPE CLEANER

[75] Inventor: Pietro Reinhart, Raiffeisenstrasse, Switzerland

[73] Assignee: Reinhart S. A., Delemont, Switzerland

[21] Appl. No.: 84,990

[22] Filed: Aug. 13, 1987

[51] Int. Cl.[5] ..... B08B 9/02

[52] U.S. Cl. ..... 15/104.061; 15/104.31

[58] Field of Search ..... 15/104.061, 104.16, 15/104.31

[56] References Cited

U.S. PATENT DOCUMENTS

| | | | |
|---|---|---|---|
| 2,354,245 | 7/1944 | Corbosiero | 15/104.31 |
| 3,262,143 | 7/1966 | Reinhart | 15/104.31 |
| 4,538,316 | 9/1985 | Reinhart | 15/104.061 |
| 4,573,231 | 3/1986 | Stocksiefen et al. | 15/104.061 |

*Primary Examiner*—Edward L. Roberts

*Attorney, Agent, or Firm*—Weingarten, Schurgin, Gagnebin & Hayes

[57] ABSTRACT

The device consists of a cleaning assembly (1) and a drive assembly (2). The cleaning assembly is composed exclusively of rigidly mounted and designed cleaning elements (3) forming a ring whose outside diameter increases from front to rear. The drive assembly is provided with flexible sealing disks (5) set vibrating by the action of water pressure and transmitting blows and vibrations to the rigidly connected cleaning assembly (1). Heavy encrustations are thus removed in stages by the cleaning assembly (1) which expands from front to rear.

6 Claims, 5 Drawing Sheets

A
B
C
11
12
13
14
15
16
17
18

PIPE CLEANER

The present invention relates to a pipe cleaner with a cleaning assembly comprising at least one ring of cleaning elements, and with a drive assembly. Known devices of this kind generally have cleaning elements with natural elasticity or spring-tensioned rigid cleaning arms or cutters. This design is based on the idea that the cleaning elements are intended to remove hard, thick encrustations in the pipe to be cleaned in order to prevent the cleaner from jamming. Experience has shown however that in the known devices the stated goal can fail to be reached in two ways, namely (1) the device remains stuck in the pipe despite the elastic or elastically suspended cleaning elements, and (2) the hard encrustations cannot be removed at all.

The goal of the present invention is to provide a remedy by virtue of the fact that rigid cleaning elements are provided in a rigid arrangement, with the effective diameter of the cleaning assembly increasing along the length thereof. It has been found that in this case even hard or tough encrustations of considerable thickness can be broken up and removed, so that safe passage of the cleaning assembly through the pipe is assured as well. Complete removal of thick and rough encrustations also has a protective effect on the drive assembly which is located behind the cleaning assembly and is powered by water pressure, with the sealing elements of said assembly, preferably made of leather, always abutting the largely cleaned and thus smooth pipe wall and hence being subject to only moderate wear.

The cleaner is especially advantageous when a water-pressure-driven drive assembly, when can be set dynamically vibrating in the drive direction, is connected rigidly with the cleaning assembly in the drive direction. In this case the vibrations or blows generated by allowing the pressurized water to flow and then shutting if off in a pulsed pattern are transmitted practically undamped to the rigid cleaning elements of the cleaning assembly, so that heavy encrustations can be effectively broken up and removed. Drive assemblies of this type are known of themselves, for example from Swiss Patent No. 402,531. The connection between the cleaning assembly and the drive assembly can be completely rigid in this case, or a ball joint, cardan joint, or universal joint can be provided which not only transmits the blows or vibrations in the drive direction but also permits mutual swiveling of the drive assembly and cleaning assembly to facilitate passage through pipe bends.

The invention will now be described in greater detail with reference to several embodiments.

Figure 7:
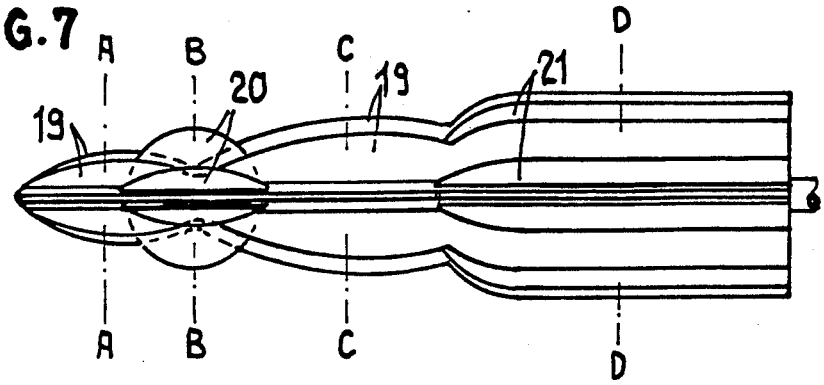
FIG. 7 shows another embodiment.
Figure 7A:
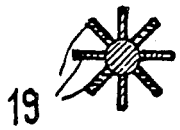
Figure 7B:
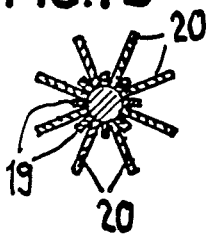
Figure 7C:
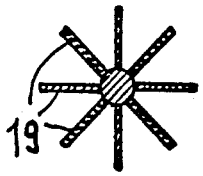
Figure 7D:
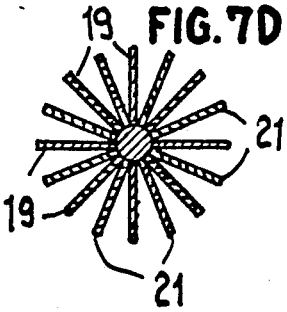
Figure 8:
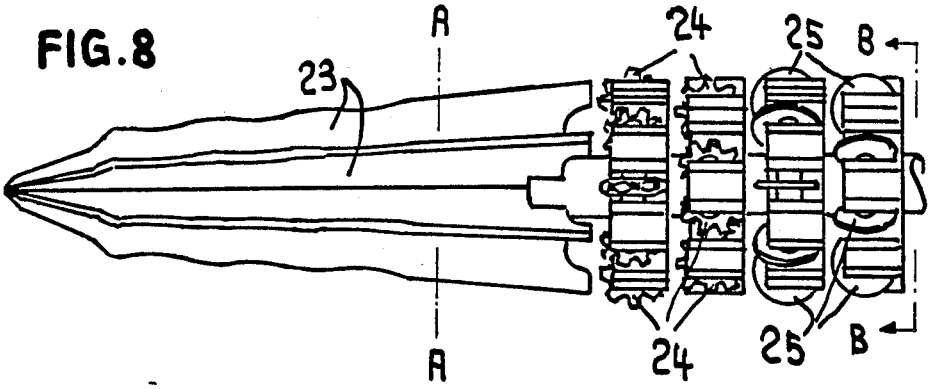
Figure 8A:
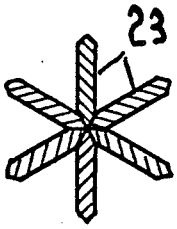
Figure 8B:
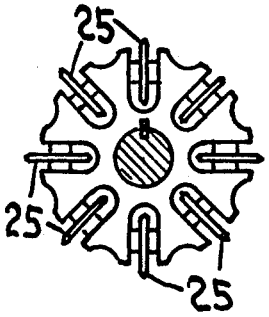
Figure 9:
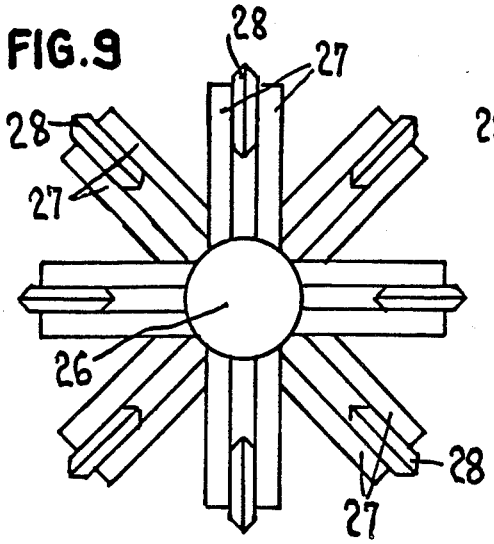
Figure 10:
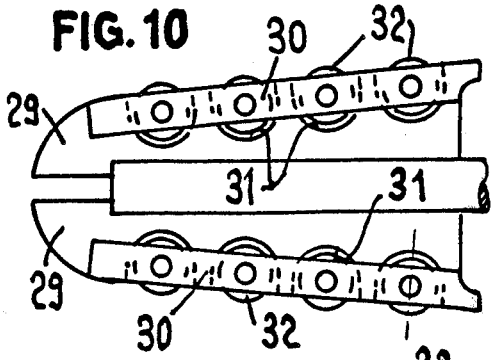
Figure 10A:
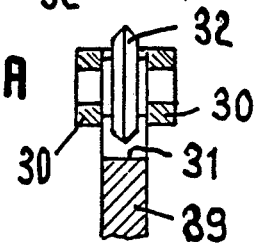
Figure 11:
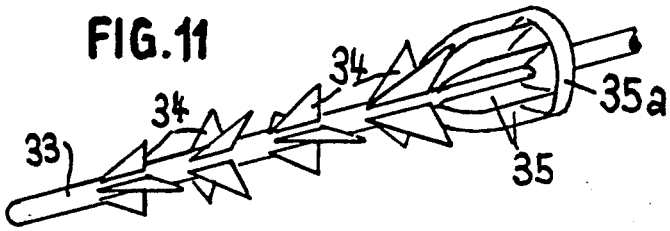

FIGS. 7/A to 7/D show cross sections along lines A/A to D/D in FIG. 7;

FIG. 8 shows another embodiment;

FIGS. 8A and 8B show sections along lines A/A and B/B in FIG. 8;

FIGS. 9 and 10 show additional embodiments;

FIG. 10A shows a partial section along line A/A in FIG. 10;

FIG. 11 shows another embodiment; and

Figure 12:
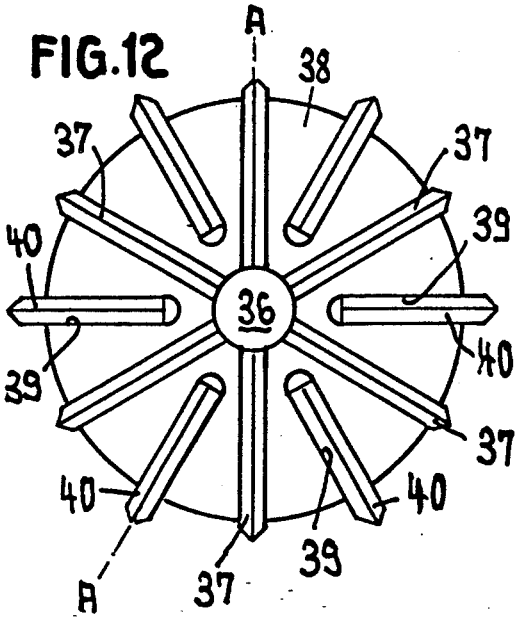
Figure 12A:
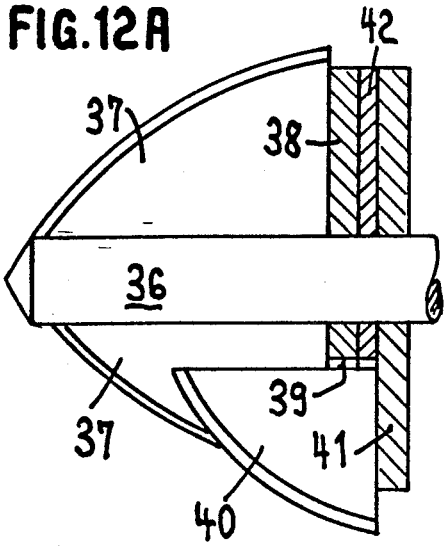

FIGS. 12 and 12A show a front view and a section through another embodiment.

Figure 1:
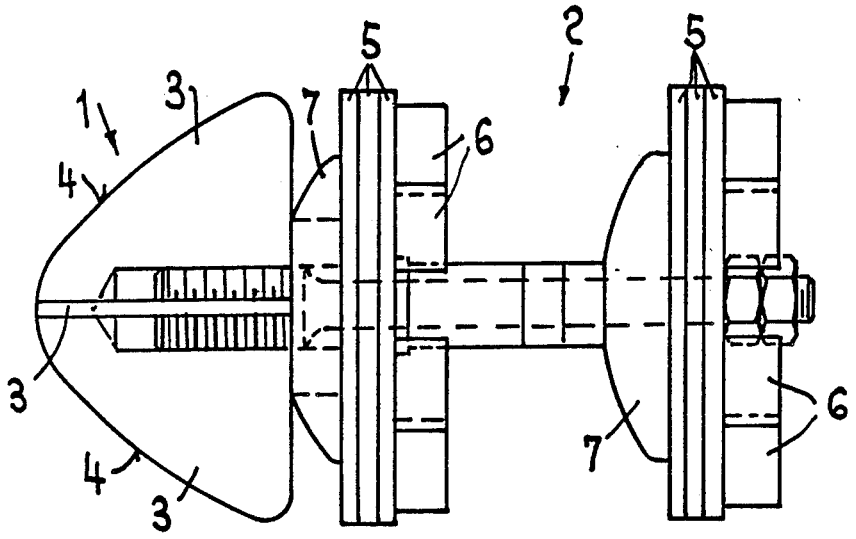
FIG. 1 shows a first, simple embodiment in a side elevation.
Figure 2:
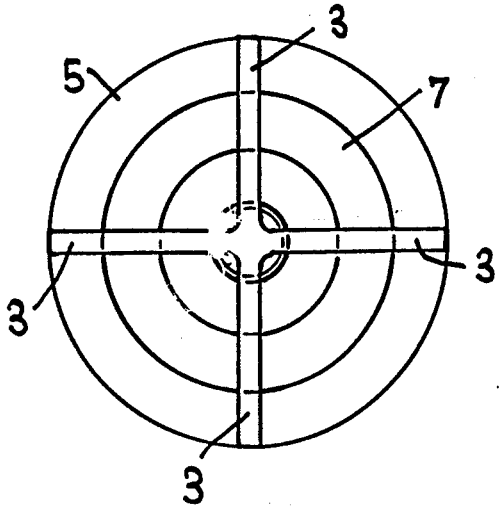
FIG. 2 is a front elevation of the device in FIG. 1.

The cleaner according to FIGS. 1 and 2 comprises a cleaning assembly 1 mounted on a common axis with a drive assembly 2. The two assemblies are therefore completely rigidly coupled together. The cleaning assembly is star-shaped with four blades 3 whose effective outer edges 4 extend outward relatively steeply. The effective diameter of the cleaning assembly thus increases from front to rear, allowing progressive removal of heavy encrustations from inside to outside, with the forward end of the cleaning assembly initially breaking up the innermost parts of the encrustation while areas of encrustation located further out are broken up by following parts of edges 4 with larger diameters. Edges 4 can be sharpened and hardened for the purpose, in order to achieve good wedge action.

Drive assembly 2 has two sealing washers 5 each of which is preferably composed of a plurality of leather disks which can be divided into segments, with the individual segments being provided with weights 6. Disks 5 abut rigid support disks 7 which transfer the hydraulic pressure acting on disks 5 rigidly to the shaft and hence to the cleaning assembly. During operation, water under extreme pressure is supplied from the right in FIG. 1 through the pipe to be cleaned. The drive assembly is so designed and the water pressure so adjusted that disks 5 with weights 6 are set vibrating in such fashion that (1) the pressurized water emerges in pulses and (2) disks 5 with weights 6 strike support disks 7, with the blows and vibrations being transmitted to cleaning assembly 3 and contributing significantly to breaking up and removing encrustations. The water passing through in pulses effectively washes away the broken-off and loosened encrustation pieces, carrying them forward through the pipe to be cleaned, i.e., to the left in FIG. 1.

Figure 3:
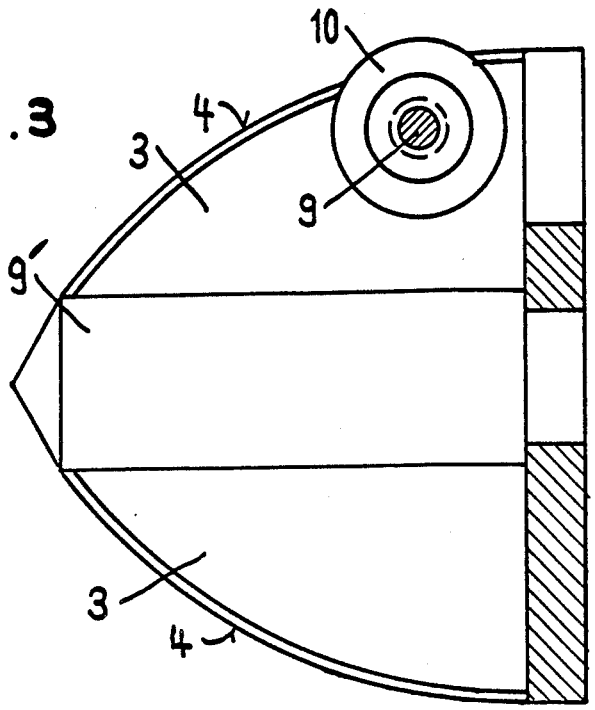
FIG. 3 shows a partial lengthwise section through a second embodiment.
Figure 4:
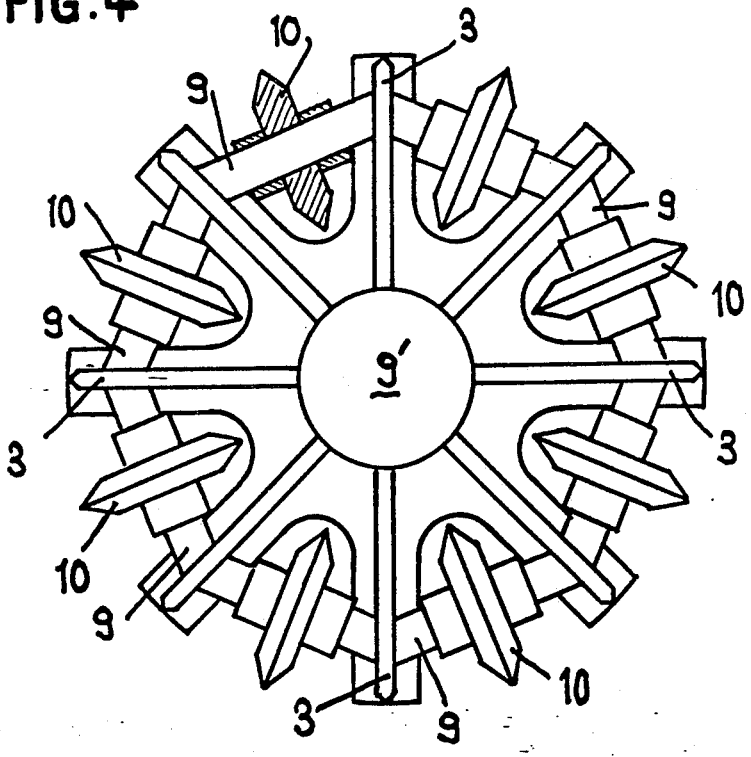
FIG. 4 shows a front view, partially cut away, of the second embodiment.

FIGS. 3 and 4 show a cleaning assembly similar to that in FIG. 1, with rigid blades 3 mounted on a core 9'. As FIG. 4 shows, blades 3 are sharpened externally to increase the wedge action. Cutting rollers 10 are rotatably mounted as additional cleaning elements at the rear end, between the blades and on shafts 9 rigidly welded to said blades. These cleaning rollers 10 are also to be viewed as rigidly mounted cleaning elements, since they cannot deflect under the pressure of the encrustations they encounter. Cleaning rollers 10 are sharpened like wedges at their circumference to increase the effect on heavy encrustations.

Figures 5, 5A, 5B, 5C, 6:
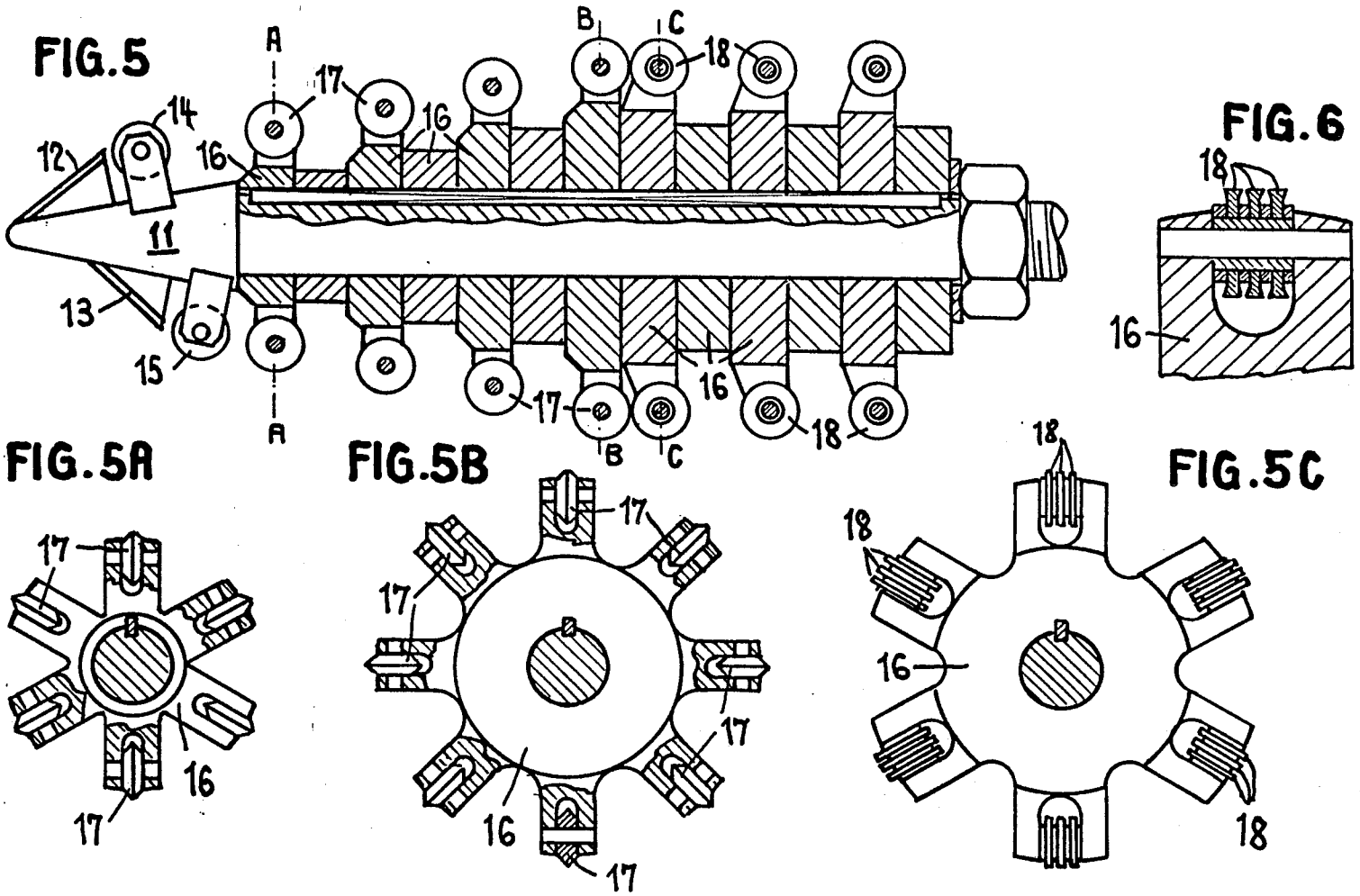
FIG. 5 shows a partial lengthwise section through another embodiment.
FIGS. 5A to 5C show sections along lines A/A to C/C in FIG. 5.
FIG. 6 shows a section through special rollers.

FIG. 5 shows another embodiment of a cleaning assembly. Two rings of blades 12 and 13 are mounted on a conical support 11 at the forward end of this assembly, with forward ring 12 having a slightly smaller outside diameter than the rear ring of blades 13. Rings of cleaning rollers 14 and 15 follow the rings of the blades; said rollers can correspond for example to the cleaning rollers in FIGS. 3 and 4. A plurality of bearing rings 16 with diameters that initially increase and then remain constant is mounted on the shaft of the cleaning assembly. Rings of cleaning rollers 17 are mounted in these bearing rings similarly to the design shown in FIGS. 3 and 4. Externally toothed cleaning rollers can also be provided. Regardless of whether the rollers are toothed or have a continuous circumferential edges, they can have a cross section as shown in FIGS. 5A–5B (rollers 17) or a cross section according to FIGS. 5C or 6 (rollers 18), with the wedge-shaped design according to FIGS. 5A and 5B serving more for breaking up the encrustations, and the roller-shaped design according to FIGS. 5C or 6 serving to crush them. Rollers 18 can also serve for centering in the pipe.

FIGS. 7 to 7/D show an embodiment with a plurality of blade rings staggered axially and circumferentially, with the diameter increasing from front to rear. This cleaning assembly is suitable for very deep and hard deposits. Its special design produces a stepwise penetration of the deposits. This cleaning assembly is also preferably connected rigidly with a drive assembly and because of its considerable length is suitable practically only for straight pipe sections. The blades are designated 19–21, with not only the diameter of the blade rings but also the number of blades per ring changing as shown in FIGS. 7/A to 7/D.

FIG. 8 shows another embodiment with an especially long, slightly conical forward part equipped with blades 23, followed by rings of increasing diameter with cleaning rollers. The two forward rings contain toothed cleaning rollers 24 and the two rear rings contain sharp-edged cleaning rollers 25. The rollers in each ring of a similar pair of rings are also staggered with respect to one another in the circumferential direction. This cleaning assembly can also be rigidly connected with a drive assembly similar to that in FIG. 1. It is also suitable for especially deep and hard deposits, with the head with the rigid blades 23 penetrating the deposit in stages to break up the latter, while rollers 24 and 25 remove the remaining layer.

FIG. 9 shows a design with especially simple construction. Pairs of bearing plates 27 are welded directly to shaft 26 of the assembly, with each welded seam simultaneously serving as the connection for two plates 27 at right angles to one another. Rings each composed of four pairs of bearing plates 27 are provided, in which plates cutting rollers 28 are mounted. Successive rings are staggered at 45 degrees or a different angle to one another, as shown in FIG. 9. Other rings can follow in the axial direction, with the diameter increasing toward the rear as shown in FIG. 9.

FIGS. 10 and 10A show another embodiment with a forward ring of cutters 29 extending outward at a relatively steep angle. Rigid supports 30 inclined slightly outward are mounted on both sides of each cutter. Rows of cleaning rollers 32 disposed sequentially in recesses 31 or cutters 29 are rigidly mounted in these supports 30, with any desired combination of rollers of the type described above being possible. Various elements of the embodiments shown can be interchanged with one another as desired. Thus for example a blade head according to FIG. 8 can be used with a roller set as shown in FIG. 10. The dimensions of the various embodiments shown can be different. Thus for example a cleaning assembly according to FIGS. 1 and 2 can be made relatively longer and can have more than four blades. A head equipped with blades according to FIGS. 1 and 2 or with more than four blades can be combined with a roller set according to FIG. 8 or FIG. 10, and more or fewer roller rings can be provided.

In addition to the cleaning rollers, guide rollers with smooth outer surface can also be provided to guide the cleaning assembly in non-encrusted pipe sections, thus avoiding an undesirably powerful action of the cleaning elements on the pipe wall.

FIG. 11 shows a design in which rings of pointed blades 34 are mounted on a long shaft 33, with the rings having diameters increasing toward the rear. This is followed by a ring of blades 35 similar to that in FIGS. 1 and 2 but directly abutting a disk **35*a*** which can serve for example as a support disk for a sealing disk of the drive assembly.

FIGS. 12 and 12A show a cleaning assembly with removably attachable parts, which can be adjusted as needed to a certain extent. On a shaft 36 it has a forward ring of six blades 37 permanently attached to the shaft, with the rear ends of the blades welded to a disk 38. Disk 38 has slots 39 running between blades 37 from the edge inward and serving as guides for the blades or cutters 40 of a mountable cutter head which engage them. Cutters 40 are welded to a disk 41 with a central hole for sliding onto shaft 36. The mountable cutter head can therefore be slid onto shaft 36 from the rear when needed and engage slots 39 with its cutters 40, while a spacing disk 42 can be inserted between plates 38 and 41. A plurality of cutter heads 40,41 can be provided, with stepped outside diameters. There are several possible applications. First, only the basic cutter head with cutters 37 can be sent through a pipe for a first cleaning pass. Then additional cutter heads 40,41 of increasing diameter can be attached for additional passes, so that eventually several cutter heads of increasing diameter are mounted in succession on shaft 36. However, the assembly can also be sent through the pipe already fitted with a plurality of cutter heads of increasing diameter; in this case the same result is achieved as with the device shown in FIG. 11. Spacing elements thicker than disk 42 can also be provided. The cutter head or heads can be secured to shaft 36 in a manner not shown.

It is generally true however that different elements of any of the embodiments shown can be combined with one another as desired, i.e. the various elements or devices can be coupled together, interchanged, or assembled sequentially.

It is essential in all embodiments that sufficient space be left between the individual cleaning elements to carry away the pressurized water passing through and especially to carry the broken-up encrustation fragments forward. There is a tendency to provide only relatively few elements, in many cases only four of them, in each ring of rigid blades or rigidly mounted rollers, and then to stagger successive rings of blades or rollers by a certain angle so that sufficient free passage is left in the individual rings while sufficient cleaning action is produced over the entire circumference of the pipe. For the same reasons it is especially advantageous to provide only relatively thin blades on supports or shafts with small diameters by comparison with the outside diameter of the blade ring or to provide slender bearing elements for the cleaning rollers.

I claim:

1. Pipe cleaner with a cleaning assembly (1) comprising at least one ring of cleaning elements (3) and with a drive assembly (2) characterized by the fact that rigid cleaning elements (3) are provided, rigidly mounted, with the effective diameter of the cleaning assembly increasing lengthwise thereof, wherein said drive assembly (2) includes a shaft, and at least one momentum transmission washer assembly adapted to vibrate in response to water pressure and transmit pulsed momentum to said cleaning elements, said washer assembly comprising a flexible sealing washer, an inertial mass attached to said sealing washer, and momentum transfer means rigidly connected to said shaft and adapted to transmit momentum from said inertial mass through said sealing washer to said cleaning element via said shaft.

2. Device according to claim 1 characterized by the fact that blades (3) are provided as said cleaning elements.

3. Device according to claim 1 characterized by the fact that rigidly mounted rollers (17,18) are provided as said cleaning elements and are provided with cutting edges to break up encrustations.

4. Device according to claim 2 wherein said blades are spaced in at least one axially and circumferential direction.

5. A pipe cleaner comprising:

a cleaning assembly including:

a conically tapering set of rigid vanes extending axially along an axis parallel to the axis of a pipe when said cleaner is in use and extending radially outward from said axis to an extent defining the conical taper;

a drive assembly extending rearward from said cleaning assembly along said axis to provide forward vibratory impetus to said cleaning assembly when inserted in a pipe carrying a pulsed flow of water, including a shaft, and at least one momentum transmission washer assembly adapted to vibrate in response to water pressure and to transmit pulsed momentum to said vanes, said washer assembly comprising a flexible sealing washer, an inertial mass attached to said sealing washer, and momentum transfer means rigidly connected to said shaft and adapted to transmit momentum from said inertial mass means through said sealing washer to said vanes via said shaft.

6. The cleaner of claim 5 further including rotating rigid elements mounted to peripheral locations of said vanes and rotatable in a plane radially extending from said axis.

* * * * *